US005162011A

United States Patent [19]

Frisque

[11] Patent Number: 5,162,011

[45] Date of Patent: Nov. 10, 1992

[54] SOUND PRODUCING NOVELTY AND PROMOTIONAL ITEM

[76] Inventor: Andrew P. Frisque, 23465 Vallarta, Laguna Niguel, Calif. 92677

[21] Appl. No.: 278,109

[22] Filed: Nov. 30, 1988

[51] Int. Cl.[5] ..... A63H 3/28

[52] U.S. Cl. ..... 446/297; 446/397

[58] Field of Search ..... 446/417, 81, 71, 75, 446/418, 415, 397, 297; 84/173, 296; 369/68

[56] References Cited

U.S. PATENT DOCUMENTS

| | | | |
|---|---|---|---|
| 789,097 | 5/1905 | Leopold | 446/418 |
| 1,652,382 | 12/1927 | Swisher | 446/397 |
| 2,762,164 | 9/1956 | Hester | 446/408 X |

FOREIGN PATENT DOCUMENTS

| | | | |
|---|---|---|---|
| 48567 | 3/1934 | Denmark | 446/397 |
| 277050 | 11/1951 | Switzerland | 446/297 |

*Primary Examiner*—Mickey Yu
*Attorney, Agent, or Firm*—W. Edward Johansen

[57] ABSTRACT

An improved sound producing novelty item includes a plastic cup, a string and a button. The plastic cup has an closed bottom end and an open top end. One end of the string is mechanically coupled to the enclosed bottom end of the plastic cup. The button is securably coupled to the other end of the string. The improved sound producing novelty item also includes a truncated hollow cone and a sponge. The truncated hollow cone has an open bottom end and an open top end. The open bottom end of the truncated hollow cone is coupled to the bottom end of the plastic cup. The sponge is slidably coupled to the string. When water is applied to the sponge, the sponge can be rubbed around and along the string to produce a sound. The external surface area of the truncated hollow cone has representations of a pair of eyes and a beak which may be disposed thereon.

1 Claim, 1 Drawing Sheet

SOUND PRODUCING NOVELTY AND PROMOTIONAL ITEM

BACKGROUND OF THE INVENTION

1. Field of the Invention

This invention relates to a sound producing novelty item and more particularly to a sound producing novelty item which may be used not only a drinking container, but also as a promotional item.

2. Description of the Prior Art

In the prior art there is a sound producing novelty item which includes a plastic cup and a string. The plastic cup, such as those cups in which soft drinks are sold, has an enclosed bottom end and an open end. At one end the string is mechanically coupled to the enclosed bottom end. The sound producing novelty item also includes a button and a sponge. The button is securably coupled to the other end of the string. The sponge is slidably coupled to the string. When water is applied to the sponge, the sponge can be rubbed around and along the string to produce a sound which simulates the sound of a chicken.

U.S. Pat. No. 4,648,852, entitled Turkey Call, issued to Landry R. Wingate on Mar. 10, 1987, teaches a turkey calling device which includes a generally rectangular-shaped call box, a slate striker plate and a striker. The call box includes rectangular walls which enclose a rectangular-shaped box sound chamber in the interior of the call box. A rectangular-shaped opening is provided in one end of the call box. The opening communicates with the box sound chamber. The slate striker plate is provided in substantially coextensive relation with respect to the box sound chamber. The striker is characterized by a handle, open striker sound chamber and a blunt striker tip. The open striker sound chamber is cylindrically-shaped and provided in one end of the handle. The blunt striker tip projects from the opposite end of the handle and engages the slate striker plate on the call box in order generate sounds which simulate the call of a wild turkey. U.S. Pat. No. 4,737,130, entitled Goose Call, issued to Sean E. Mann on Apr. 12, 1988, teaches a goose calling device. U.S. Pat. No. 4,761,149, entitled Elk Calling Device, issued to Donald R. Lauach on Aug. 2, 1988, teaches an elk calling device.

U.S. Pat. No. 4,714,444, entitled Drink Can Glider, issued to Robert D. Rendel on Dec. 22, 1987, teaches an improved aircraft which includes a wing saddle, a wing and a mechanism for releasably securing the saddle to the wings. The improved aircraft also includes a tail, a mechanism for releasably securing the tail to the saddle and a mechanism for releasably at least one can to the saddle. The improved aircraft utilizes at least one can as a fuselage.

U.S. Pat. No. 4,758,194, entitled Novelty Handler-Type Toy and Containers, issued to Ellen Wyatt on Jul. 19, 1988, teaches a handler-type toy which includes a cup housing, and a pair of cups and a cover. Each cup has a rim portion which is received within the cup housing for storage of paper currency and other articles. The cover is received on the cup and retains paper clips. A sticker is respectively secured to a bottom wall of each cup for amusement.

U.S. Pat. No. 4,701,149, entitled Method and Apparatus for Bicycle Noise Making System, issued to James J. Breil on Oct. 20, 1987, teaches a device for securing a balloon to a frame member of a bicycle having at least one wheel supported by spokes attached to the frame.

The rotational movement of the wheel produces a motor-type sound.

U.S. Pat. No. 4,386,774, entitled Ball Marker and Ground Repair Tool, issued to Charles E. Buckman on Jun. 7, 1983, teaches a ball marker and ground repair tool for use in holding and placing a ball marker and replacing a divot. A logo may be placed on the ball marker and ground repair tool.

U.S. Pat. No. 3,618,673, entitled Tool for Repairing Divots Made by Golf Balls, issued to Fred C. Gossett on Nov. 9, 1971, teaches a thermoplastic tool for digging into the turf of a golf course to repair a depression in the earth made by a golf ball. The tool has a V-shaped blade portion with a radiused puncture point and an integral handle with a transverse manipulating rib and a depressed area for advertising material in the handle.

U.S. Pat. No. 4,764,140, entitled Mexican Jumping Bean Toy, issued to Nelson Wood on Aug. 16, 1988, teaches a Mexican jumping bean ring which includes a main ringer engaging band, a container and a Mexican jumping bean. The container is affixed to the main finger engaging band. An area cut out from the base of the container facing the finger of the wearer. The Mexican jumping bean is placed within the container.

SUMMARY OF THE INVENTION

In view of the foregoing factors and conditions which are characteristic of the prior art it is the primary object of the present invention to provide a sound producing novelty item which may be used not only as a drinking container, but also as a promotional item.

In accordance with the present invention an embodiment of an improved sound producing novelty item is described. The improved sound producing novelty item includes a plastic cup, a string and a button. The plastic cup has an closed bottom end and an open top end. One end of the string is mechanically coupled to the enclosed bottom end of the plastic cup. The button is securably coupled to the other end of the string. The improved sound producing novelty item also includes a truncated hollow cone and a sponge. The truncated hollow cone has an open bottom end and an open top end. The open bottom end of the truncated hollow cone is coupled to the bottom end of the plastic cup. The sponge is slidably coupled to the string. When water is applied to the sponge, the sponge can be rubbed around and along the string to produce a sound. The external surface area of the truncated hollow cone has representations of a pair of eyes and a beak which may be disposed thereon.

The features of the present invention which are believed to be novel are set forth with particularity in the appended claims.

Other claims and many of the attendant advantages will be more readily appreciated as the same becomes better understood by reference to the following detailed description and considered in connection with the accompanying drawing in which like reference symbols designate like parts throughout the figures.

DESCRIPTION OF THE PREFERRED EMBODIMENT

Figure 1:
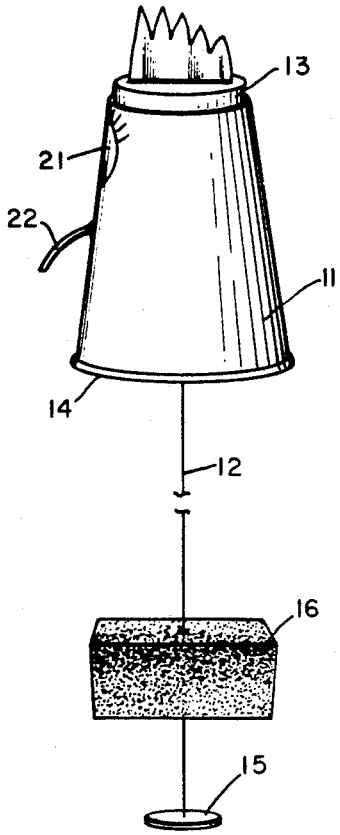
Fig. 1. (Prior Art)
FIG. 1 is a perspective view of a sound producing novelty item of the prior art.

In order to understand the present invention it is necessary to refer to the following description of a sound producing novelty item of the prior art. Referring to FIG. 1 a sound producing novelty item 10 includes a plastic cup 11 and a string 12. The plastic cup 11 has an enclosed bottom end 13 and an open end 14. At one end the string 12 is mechanically coupled to the enclosed bottom end 13. The sound producing novelty item 10 also includes a button 15 and a sponge 16. The button 15 is securably coupled to the other end of the string 12. The sponge 16 is slidably coupled to the string 12. When water is applied to the sponge 16, the sponge 16 can be rubbed around and along the string 12 to produce a sound which simulates the sound of a chicken. The external surface area of the plastic cup 11 has representations of a pair of eyes 21 and a beak 22 which are disposed thereon.

Figure 2:
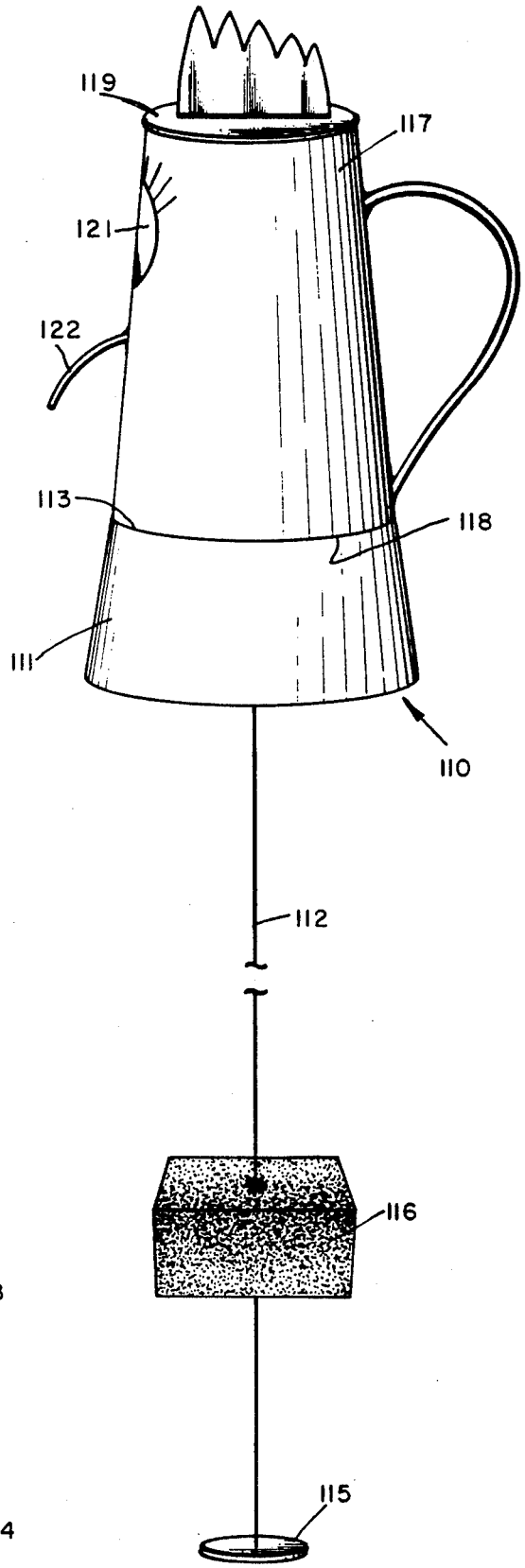
FIG. 2 is a perspective view of an improved sound producing novelty item which has been constructed in accordance with the principles of the present invention.
Figure 3:
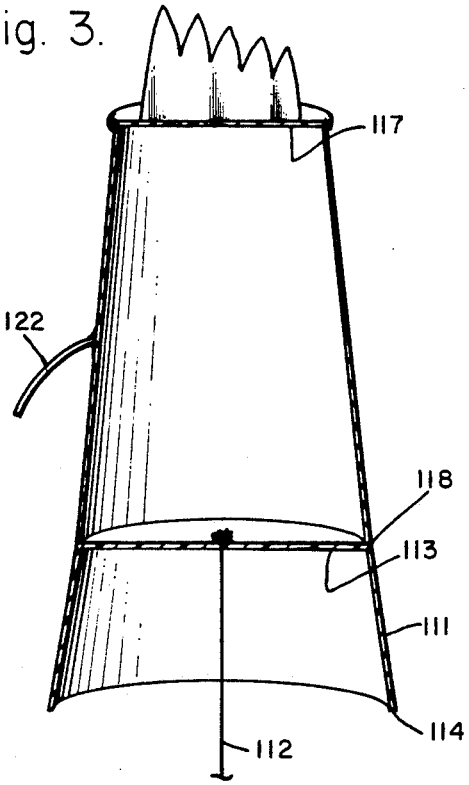
FIG. 3 is a perspective view of the improved sound producing novelty item of FIG. 2.

Also in order to understand the present invention it is necessary to refer to the following description of its preferred embodiment in conjunction with the accompanying drawing. Referring to FIG. 2 in conjunction with FIG. 3 an improved sound producing novelty item 110 includes a plastic cup 111 and a string 112. The plastic cup 111 has an closed bottom end 113 and an open top end 114. At one end the string 112 is mechanically coupled to the enclosed bottom end 113. The improved sound producing novelty item 110 also includes a button 115 and a sponge 116. The button 115 is securably coupled to the other end of the string 112. The sponge 116 is slidably coupled to the string 112. When water is applied to the sponge 116, the sponge 116 can be rubbed around and along the string 112 to produce a sound which can simulate the sound of a chicken. The improved sound producing novelty item 110 further includes a truncated hollow cone 117 which has an open bottom end 118 and an open top end 119. The open bottom end 118 of the truncated hollow cone 117 is either securably or detachably coupled to the bottom end 113 of the plastic cup 111. The external surface area of the truncated hollow cone 117 has representations of a pair of eyes 121 and a beak 122 which are disposed thereon.

From the foregoing it can be seen that an improved sound producing novelty item has been described. It should be noted that the sketches are not drawn to scale and that distance of and between the figures are not to be considered significant.

Accordingly it is intended that the foregoing disclosure and showing made in the drawing shall be considered only as an illustration of the principles of the present invention.

What is claimed is:

1. An improved sound producing novelty item comprising:

a. a plastic cup which has an closed bottom end and an open top end;

b. a string one end of which is mechanically coupled to said closed bottom end of said plastic cup;

c. a button which is securably coupled to the other end of said string;

d. a truncated hollow cone which has an external surface area, an open bottom end and an open top end with said open bottom end of said truncated hollow cone being securably coupled to said bottom end of said plastic cup whereby said external surface area of said truncated hollow cone has representations of a pair of eyes and a beak which are disposed thereon; and e. a sponge which is slidably coupled to said string whereby when water is applied to said sponge, said sponge can be rubbed around and along said string to produce a sound which simulates the sound of a chicken.

* * * * *